US008894445B2

(12) United States Patent
Jol et al.

(10) Patent No.: US 8,894,445 B2
(45) Date of Patent: Nov. 25, 2014

(54) CONNECTOR RECEPTACLE WITH SIDE GROUND CONTACTS

(71) Applicant: Apple Inc., Cupertino, CA (US)

(72) Inventors: Eric S. Jol, San Jose, CA (US); Trent K. Do, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 92 days.

(21) Appl. No.: 13/629,477

(22) Filed: Sep. 27, 2012

(65) Prior Publication Data

US 2013/0260615 A1 Oct. 3, 2013

Related U.S. Application Data

(63) Continuation-in-part of application No. 13/607,439, filed on Sep. 7, 2012.

(60) Provisional application No. 61/597,133, filed on Feb. 9, 2012.

(51) Int. Cl.
*H01R 24/00* (2011.01)

(52) U.S. Cl.
USPC ..... 439/660; 439/108

(58) Field of Classification Search
USPC ..... 439/660, 108, 355
See application file for complete search history.

(56) References Cited

U.S. PATENT DOCUMENTS

| | | | | |
|---|---|---|---|---|
| 8,292,674 | B1 * | 10/2012 | Yang et al. | 439/660 |
| 8,419,473 | B1 * | 4/2013 | Lan et al. | 439/607.17 |
| 8,430,695 | B2 * | 4/2013 | Ting et al. | 439/660 |
| 8,475,218 | B2 * | 7/2013 | Zheng et al. | 439/660 |
| 2003/0109151 | A1 | 6/2003 | Xu | |
| 2007/0105449 | A1 | 5/2007 | Murayama | |
| 2009/0280694 | A1 | 11/2009 | Zhuang et al. | |
| 2011/0013872 | A1 | 1/2011 | Zhang et al. | |

FOREIGN PATENT DOCUMENTS

| | | | |
|---|---|---|---|
| JP | 07-33395 | Y2 | 7/1995 |
| WO | 2011/150403 | A1 | 12/2011 |
| WO | 2011/150403 | A9 | 12/2011 |
| WO | 2011/163256 | A1 | 12/2011 |

OTHER PUBLICATIONS

International Search Report and Written Opinion mailed on Jun. 28, 2013 for PCT Patent Application No. PCT/US2013/036656, 15 pages.

International Search Report and Written Opinion mailed on Jun. 2, 2013 for PCT Patent Application No. PCT/US2013/025599, 10 pages.

* cited by examiner

*Primary Examiner* — Hien Vu

(74) *Attorney, Agent, or Firm* — Kilpatrick Townsend & Stockton LLP

(57) ABSTRACT

Connector receptacles having a contoured form factor that allows their use in stylized enclosures. These receptacles may also be contoured to avoid circuitry internal to the device enclosure. The contoured form factor may also simplify the assembly of the connector receptacle.

17 Claims, 24 Drawing Sheets

CONNECTOR RECEPTACLE WITH SIDE GROUND CONTACTS

CROSS-REFERENCES TO RELATED APPLICATIONS

This application is a continuation-in-part of U.S. patent application Ser. No. 13/607,439, filed Sep. 7, 2012, which claims the benefit of U.S. provisional patent application No. 61/597,133, filed Feb. 9, 2012, which are incorporated by reference.

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive and provide power and data using various cable assemblies. These cable assemblies may include connector inserts, or plugs, on one or more ends of a cable. The connector inserts may plug into connector receptacles on electronic devices, thereby forming one or more conductive paths for signals and power.

The connector receptacles may be formed of housings that typically at least partially surround and provide mechanical support for contacts. These contacts may be arranged to mate with corresponding contacts on the connector inserts or plugs to form portions of electrical paths between devices. The connector receptacles may further include features to help to provide an initial resistance to the insertion of a connector insert. Features to provide retention to prevent inadvertent removal of a connector insert may also be included.

These connector receptacles may be attached or otherwise fixed to device enclosures that surround an electronic device. These enclosures may be highly stylized for both aesthetic and functional reasons. For example, portions of the device enclosures may be sloped, curved, or have other non-orthogonal shapes. These enclosures may also be thin or narrow.

The curvature or size of these enclosures may make it difficult to fit a connector receptacle to the enclosure. Moreover, a resulting connector receptacle may be difficult to assemble.

Also, these connector receptacles consume space inside the electronic device. This consumed space may mean that the device may become larger, some functionality may be lost, or that some tradeoff may have to be made. These losses may be mitigated by further contouring or reducing the size of the connector receptacle.

Thus, what is needed are connector receptacles that are contoured or reduced in size to fit in these stylized enclosures, avoid internal circuitry, provide a desired level of retention for a connector insert, and are relatively easy to assemble.

SUMMARY

Accordingly, embodiments of the present invention may provide connector receptacles having a contoured or reduced size form factor that allows use in stylized enclosures. These receptacles may also be contoured or reduced in size to avoid circuitry internal to the device enclosure. The contoured or reduced size form factor may also simplify the assembly of the connector receptacle. These connector receptacles may also include a latch piece to provide insertion resistance and retention features. This latch may provide both resistance to the insertion of a connector inserts and to prevent their inadvertent or accidental removal.

An illustrative embodiment of the present invention may provide a connector receptacle that may be contoured or reduced in size to fit in a curved device enclosure. To enable this fit, the connector receptacle may have an opening on a bottom of a housing. This opening may allow the insertion of contacts into place in the housing during assembly, thereby simplifying the assembly of the connector receptacle.

An illustrative embodiment of the present invention may provide a connector receptacle having a housing. The housing may have a front opening to accept a connector insert. The housing may have a bottom opening. The housing may further have first and second fastener openings, into which fasteners may be placed to fix the connector receptacle to a device enclosure. The housing may be plastic or other nonconductive material.

During assembly, contacts may be inserted into the housing through an opening in a bottom of the housing. These contacts may include a beam portion. The beam portion may be that part of a contact that is arranged to form an electrical connection with a corresponding contact on a connector insert when the connector insert is inserted into the connector receptacle. The contacts may further include a surface mount contact substantially in line with the beam portion, where the surface mount contacts are arranged to be soldered to a flexible circuit board, printed circuit board, or other appropriate substrate. The contacts may each further include a mechanical stabilizing portion substantially orthogonal to the beam portion. The mechanical stabilizing portion may be inserted into slots in the housing during assembly.

To protect these contacts after assembly, a piece of tape or other cover may be placed over at least a portion of the opening in the bottom of the housing.

The connector receptacle may further include a latch or ground piece. The latch or ground piece may include contacts at each end, which are joined by a back piece. The contacts may be placed in the housing through a back opening such that ground contacts on sides of a connector insert are in electrical contact with the contacts.

The contacts on the latch or ground piece may further provide retention features for the receptacle. The retention features may provide a resistance to the insertion of a connector insert into the connector receptacle. The retention features may further provide a holding force to help keep the connector insert in place and reduce or prevent the inadvertent removal of the connector insert. However, during assembly, the contacts on the ground piece may be spread apart. This may also occur during insertion of a connector inserts. This spreading may reduce the retention force provided by the ground piece contacts, which may also lead to a reduced reliability for the ground contacts. To reduce this loss in retention the ground piece may be annealed. To provide a further reduction in loss, the ground piece may further be hardened, though the annealing step may be omitted. In other embodiments of the present invention, one or more annealing, hardening, and other processing steps may be used.

The connector receptacle may further include a bracket. The bracket may include a first fastener opening and a second fastener opening. The first fastener opening may align with the first fastener opening in the housing, while the second fastener opening may align with the second fastener opening in the housing. Again, fasteners may be placed in the fastener openings in order to attach or fix the connector receptacle to a device enclosure. The bracket may include tabs arranged to fit in cutouts on the housing to secure the bracket to the housing. Either or both the ground piece or bracket may include tabs, which may be soldered to ground paths on a flexible circuit board, printed circuit board, or other appropriate substrate, though one or more of these tabs may be included on the ground piece or other portion of the connector receptacle. The contacts, latch or ground piece, ground contacts, shield, and bracket may be formed of plastic, metal, ceramic, or other materials. For example, they may be formed of stainless steel, such as stainless steel (304), stainless steel (301), or low carbon steel (1010), titanium, brass, gold-plated brass, or other appropriate material.

Another illustrative embodiment of the present invention provides a method of assembling a connector receptacle. This method may include receiving a housing. The housing may be contoured to fit in a stylized enclosure. The housing may have a front opening, a bottom opening, and a back opening. Contacts may be placed into the housing through the bottom opening. The contacts may include beam, surface mount, and mechanical stabilizing portions. The mechanical stabilizing portions may be inserted into slots in the housing. A first piece of tape may be placed over the bottom opening in the housing. In other embodiments of the present invention, a shield portion, or plastic portion, may be used in place of the tape.

A latch or ground piece including ground contacts may be inserted into the back opening of the housing. A tab on the housing may fit in a notch in the ground piece to hold the ground piece in place. A second piece of tape, which may be two-sided, may be placed over a back portion of the ground piece. A bracket may be fixed to the housing and held in place by the second piece of tape. The bracket may include tabs that fit into cutouts in the housing to hold the bracket in place. Fasteners may be placed through fastener openings in the housing and bracket to attach the connector receptacle to a device enclosure. These enclosures may be enclosures for portable computing devices, tablet, desktop, and all-in-one computers, cell, smart, and media phones, storage devices, portable media players, navigation systems, monitors and other devices.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
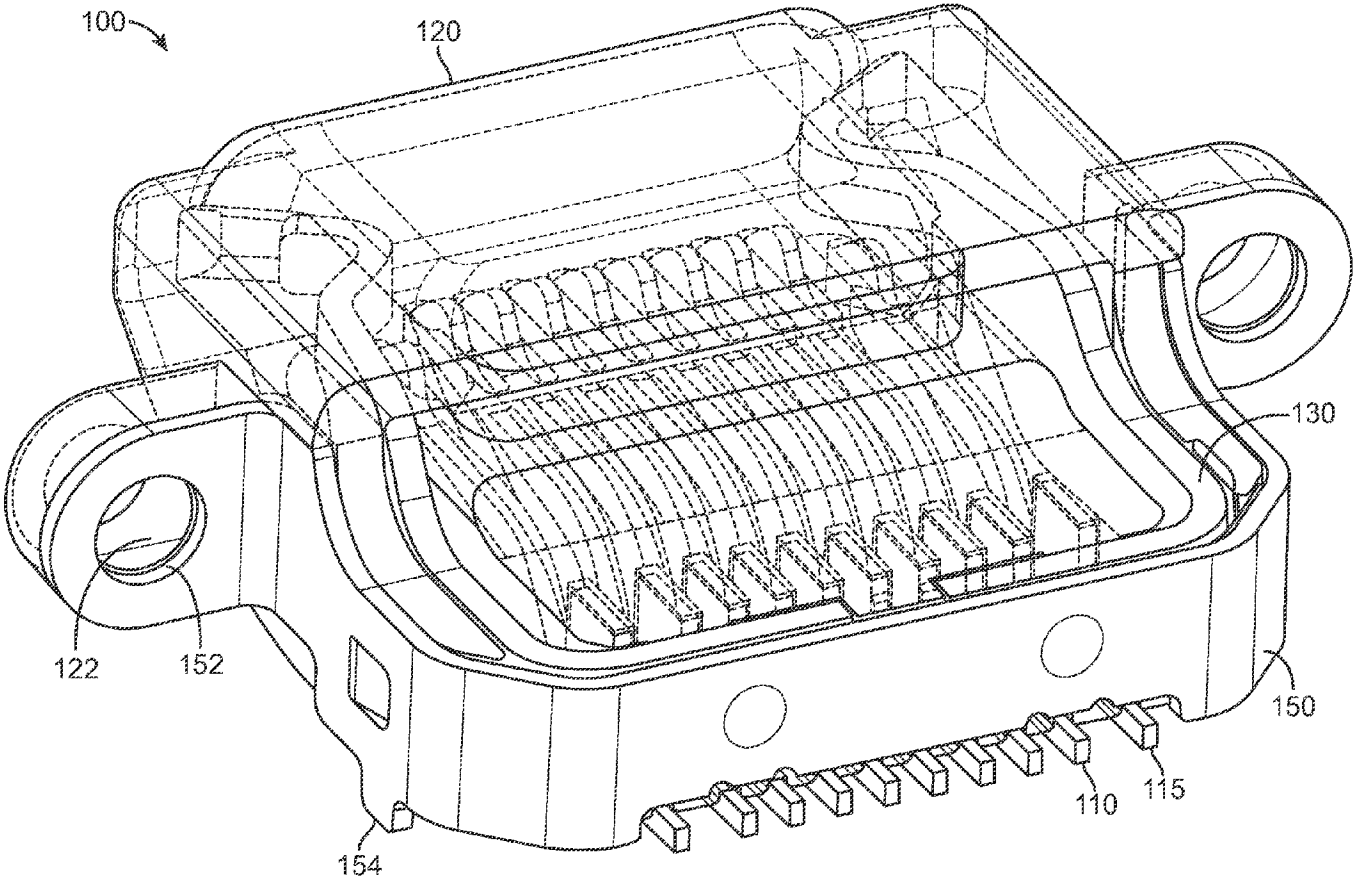
FIG. 1 illustrates a rear oblique view of a connector receptacle according to an embodiment of the present invention.

FIG. 1 illustrates a rear oblique view of a connector receptacle according to an embodiment of the present invention. This figure, as with the other included figures, is shown for illustrative purposes only and does not limit either the possible embodiments of the present invention or the claims.

Connector receptacle 100 may include a number of contacts 110 and 115 located in housing 120. Contacts 110 and 115 may convey power, ground, signals, bias voltages, polarity detect signals, or other types of signals or voltages. Ground piece 130 may be inserted into a rear opening in housing 120. Bracket 150 may cover a rear portion of ground piece 130 and housing 120. Tabs 154 may be inserted in a flexible circuit board, printed circuit board, or other substrate. Contacts 110 and 115 may connect to the same or different flexible circuit board, printed circuit board, or other substrate. Fastener openings 122 in housing 120 and 152 in bracket 150 may be used to hold fasteners. These fasteners may secure connector receptacle 100 to a device enclosure, or other structure that is in turn attached to the device enclosure.

Figure 2:
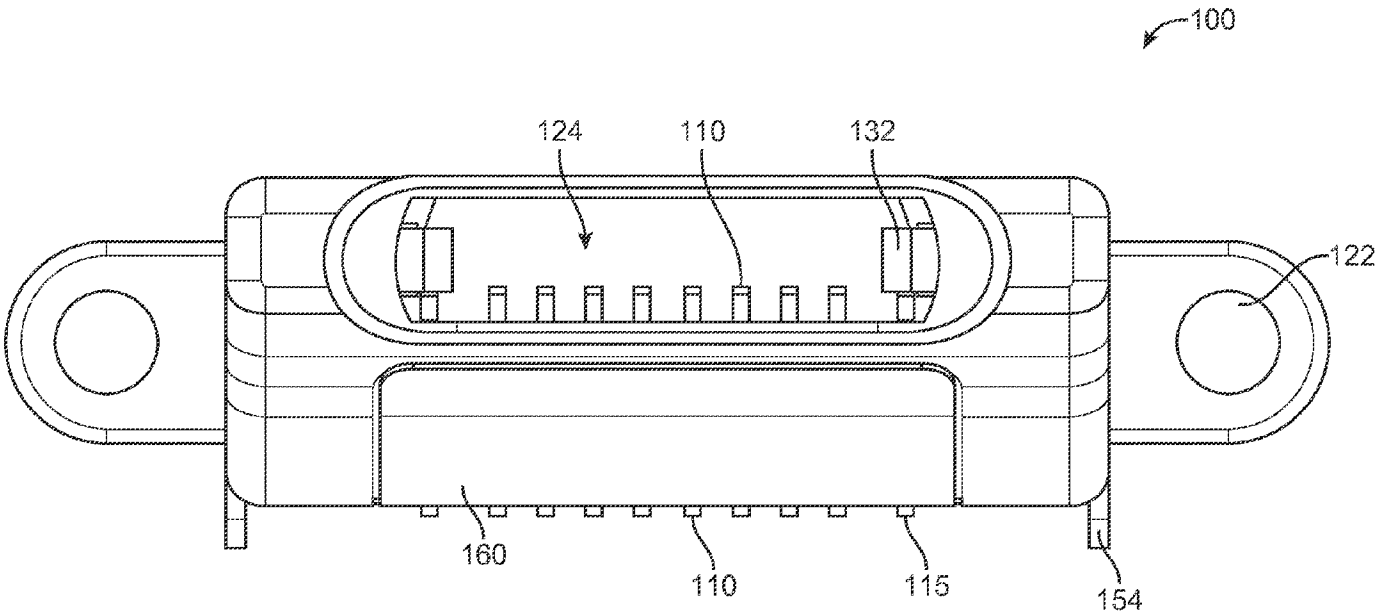
FIG. 2 illustrates a front view of a connector receptacle according to embodiment of the present invention.

FIG. 2 illustrates a front view of a connector receptacle according to embodiment of the present invention. Connector receptacle 100 may include a front opening 124 to accept a connector insert. Contacts in the connector insert may form electrical connections with contacts 110 and 115 in connector receptacle 100. Ground contacts on sides of the connector insert may contact ground contacts 132, which may be formed as ends of ground piece 130. As before, tabs 154 and contacts 110 and 115 may connect to a flexible circuit board, printed circuit board, or other appropriate substrate. Fastener opening 122 may be used to hold a fastener, which may secure receptacle 100 to a device enclosure, or structure that is fixed or otherwise attached to a device enclosure.

In this embodiment, as will be shown in further detail below, a front of connector receptacle 110 may be sloped. This sloping may be configured to fit in a curved portion of a device enclosure. To save space, the bottom portion may further be open. To protect contacts 110 and 115, tape or cover 160 may be used to cover this opening after assembly of connector receptacle 100.

Figure 3:
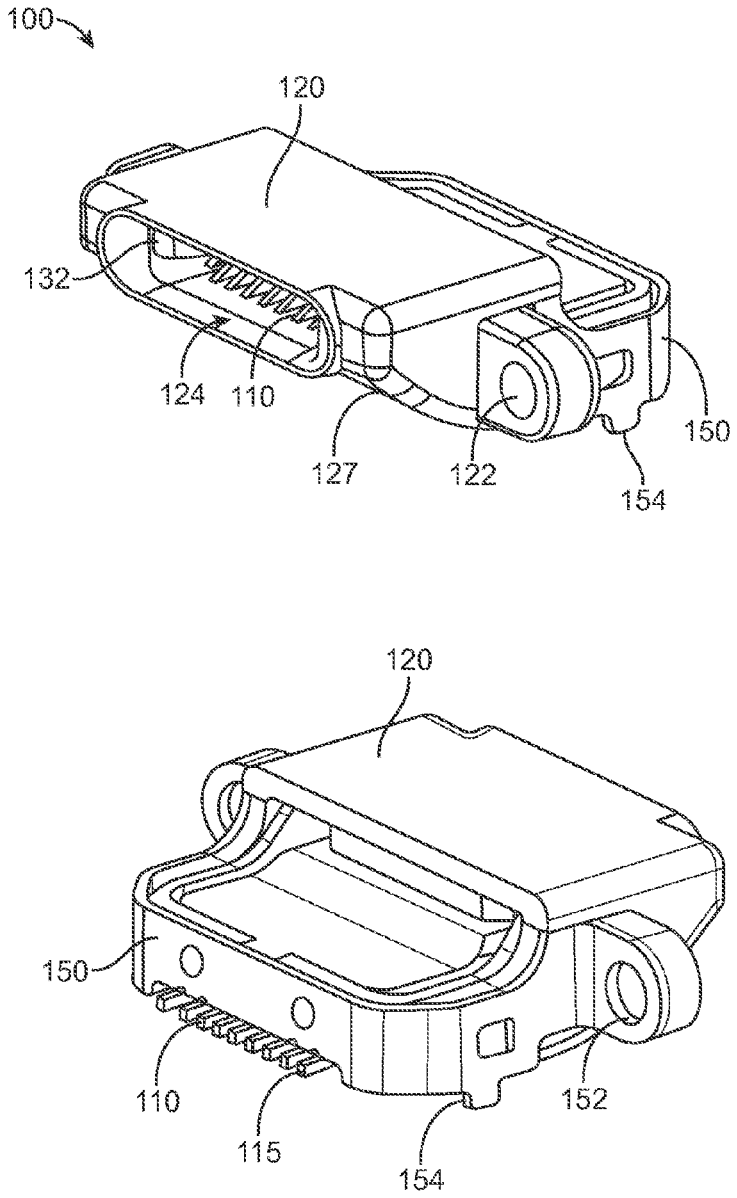
FIG. 3 illustrates front and rear oblique views of a connector receptacle according to an embodiment of the present invention.

FIG. 3 illustrates front and rear oblique views of a connector receptacle according to an embodiment of the present invention. Connector receptacle 100 may include housing 120 having a front opening 124. Front opening 124 may allow access to contacts 110 and 115, as well as side ground contacts 132, by a connector insert. Again, bracket 150 may include tabs 154 and fastener openings 152.

Again, this receptacle may be contoured to fit a curvature or other shape of a device enclosure. In this specific embodiment of the present invention, front surface 127 is curved, as shown.

Figure 4:
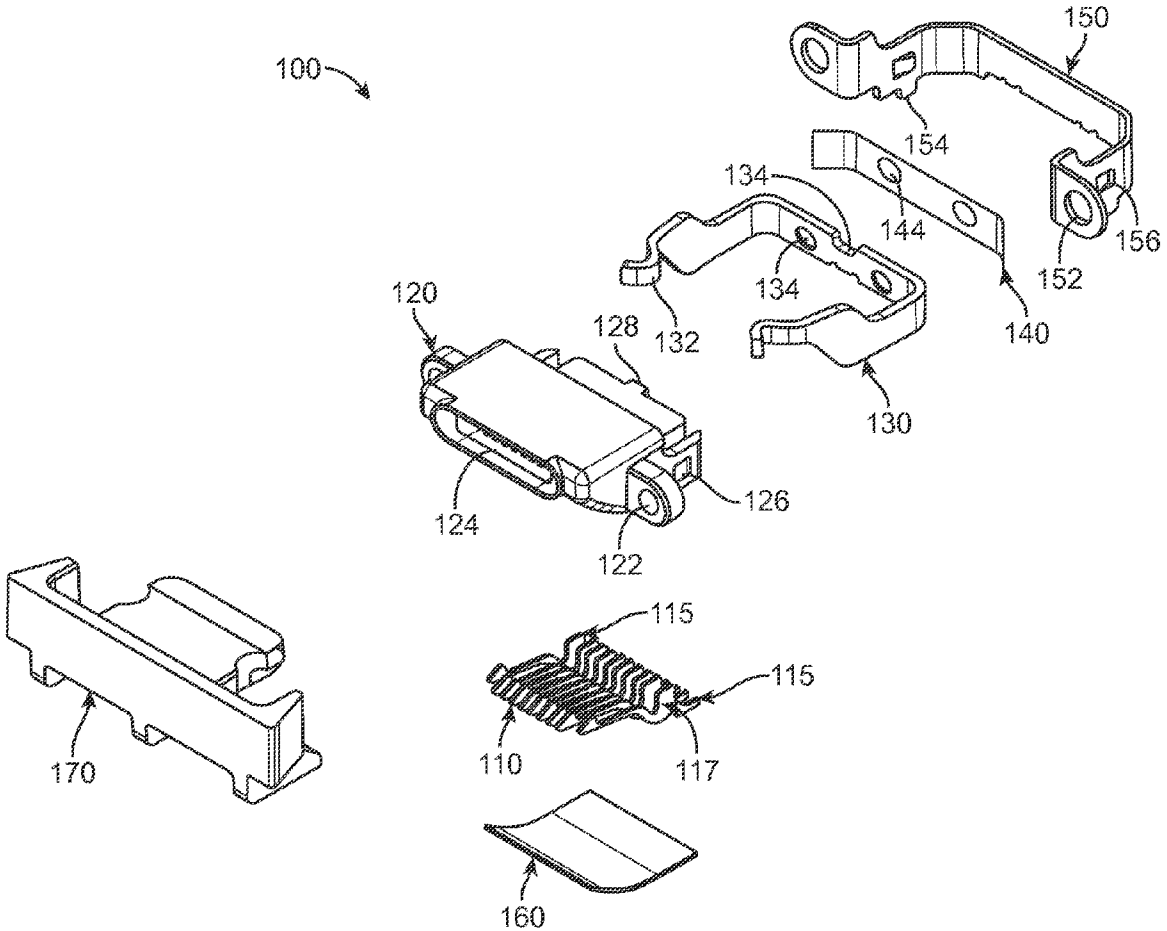
FIG. 4 illustrates an exploded view of a connector receptacle according to an embodiment of the present invention.

FIG. 4 illustrates an exploded view of a connector receptacle according to an embodiment of the present invention. This exploded view includes a solder guard 170, which may be used to protect contacts 110 and 115 during assembly, particularly when connector receptacle 100 is attached to a flexible circuit board, printed circuit board, or other appropriate substrate.

This connector receptacle may include a housing 120. Housing 120 may include a front opening 124 to accept a connector insert. Housing 120 may further include fastener openings 122 and cutouts 126. Cutouts 126 may be used to accept a tab 156 on bracket 150. Housing 120 may further include tab 128, which may be notched to fit in notch 134 in latch or ground piece 130. This may assist in holding latch or ground piece 130 in place during assembly.

Contacts 110 and 115 may be inserted into housing 120 via an opening on a bottom side (not shown). Specifically, mechanical stabilization portions 117 may be inserted into slots in housing 120. To protect contacts 110 and 115, a cover or tape portion 160 may be used to cover the bottom side opening in housing 120.

Latch or ground piece 130 may include side ground contacts 132 and dimples or protrusion 134. Ground contacts 132 may be inserted into housing 120 during assembly.

Bracket 150 may be attached to the back of connector receptacle 100. To facilitate this, a tape piece 140 may be used. Tape piece 140 may be two-sided tape. Tape piece 140 may include openings 144, which may be aligned with protrusions 134. Protrusions 134 may be spot or laser-welded to brackets 150 during assembly.

Figure 5:
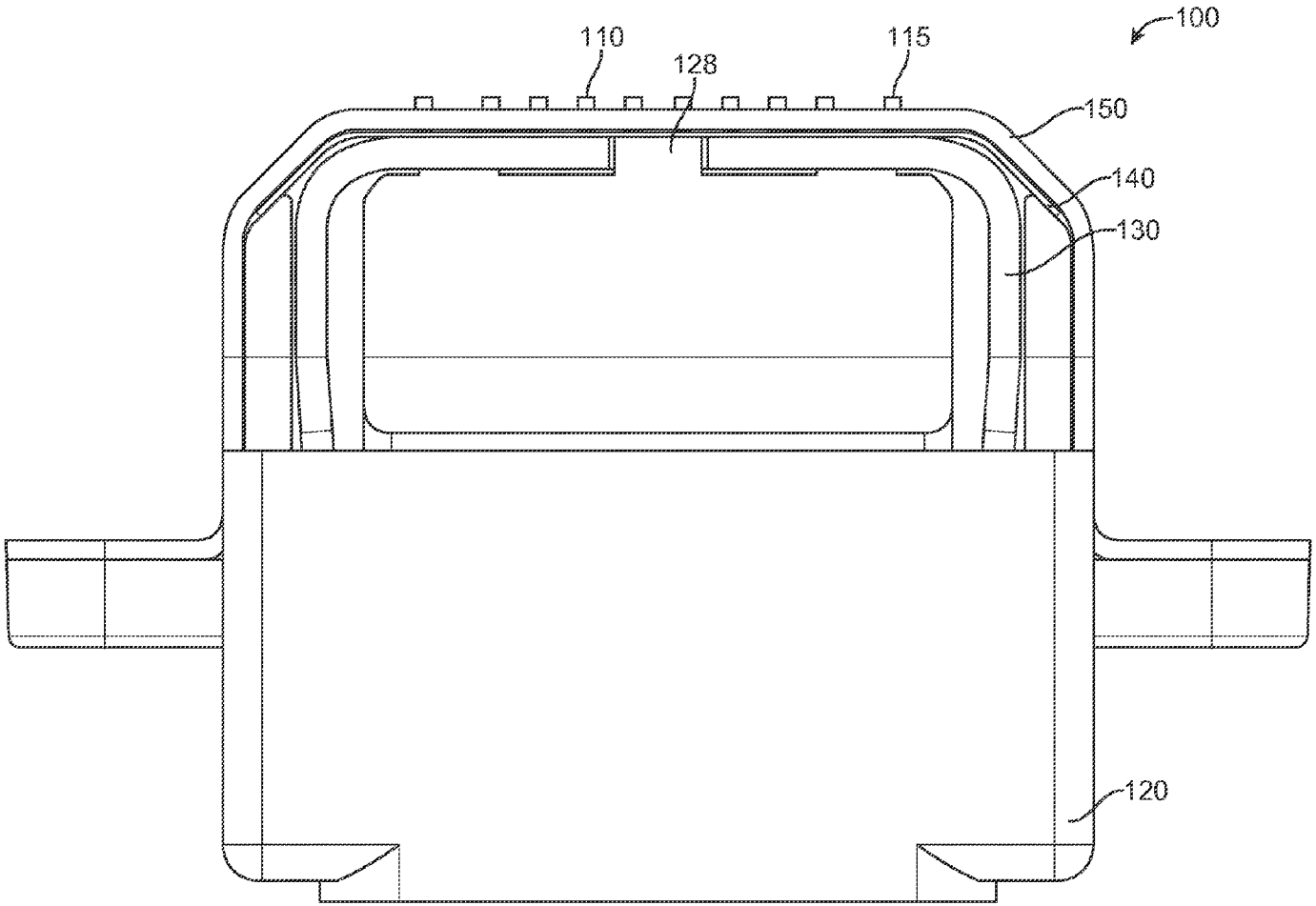
FIG. 5 illustrates a top view of a connector receptacle according to an embodiment of the present invention.

FIG. 5 illustrates a top view of a connector receptacle according to an embodiment of the present invention. Again, connector receptacle 100 may include housing 120 around contacts 110 and 115. Ground piece 130 and bracket 150 may be located near a back of the connector receptacle. Tab or rib 128 may be used to hold latch or ground piece 130 in place during assembly. Tape portion 140 may be used to hold bracket 150 in place during assembly.

Figure 6:
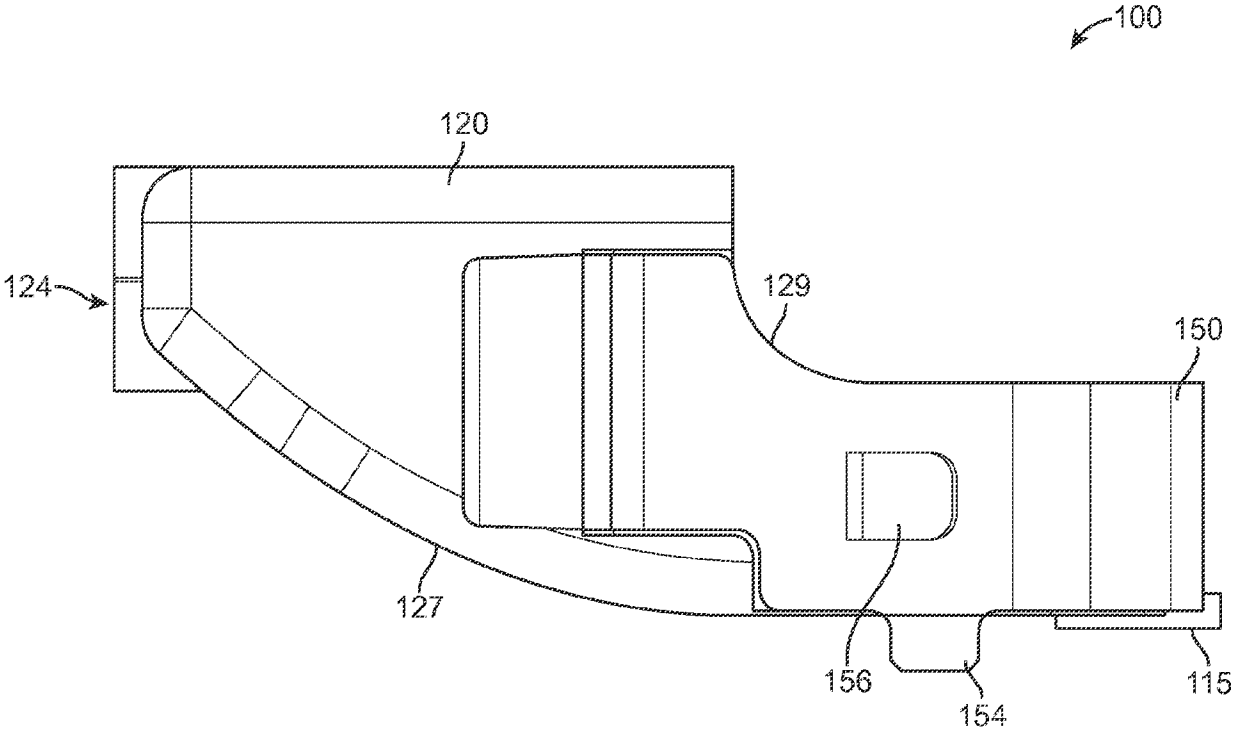
FIG. 6 illustrates a side view of a connector receptacle according to an embodiment of the present invention.

FIG. 6 illustrates a side view of a connector receptacle according to an embodiment of the present invention. Again, connector receptacle 100 may include housing 120 having a back portion partially covered by bracket 150. Bracket 150 may include tabs 154 and 156. Tab 156 may insert into a cutout (not shown) in housing 120 to secure bracket 150 to housing 120. Connector receptacle 100 may include a front opening 124 to accept the connector insert.

Again, connector inserts according to embodiments of the present invention may be contoured to fit device enclosures. Accordingly, a front portion 127 of connector receptacle 100 may be curved. This curvature may match or fit in a curvature of a device enclosure.

Also, this connector receptacle may be arranged to avoid circuitry internal to the device. Accordingly, curved surface 129 may be shaped such that connector receptacle 100 avoids such internal circuitry.

To save space and allow front surface 127 to be curved in this way, embodiments the present invention may provide an opening on a bottom of housing 120. This is shown in the following figure.

Figure 7:
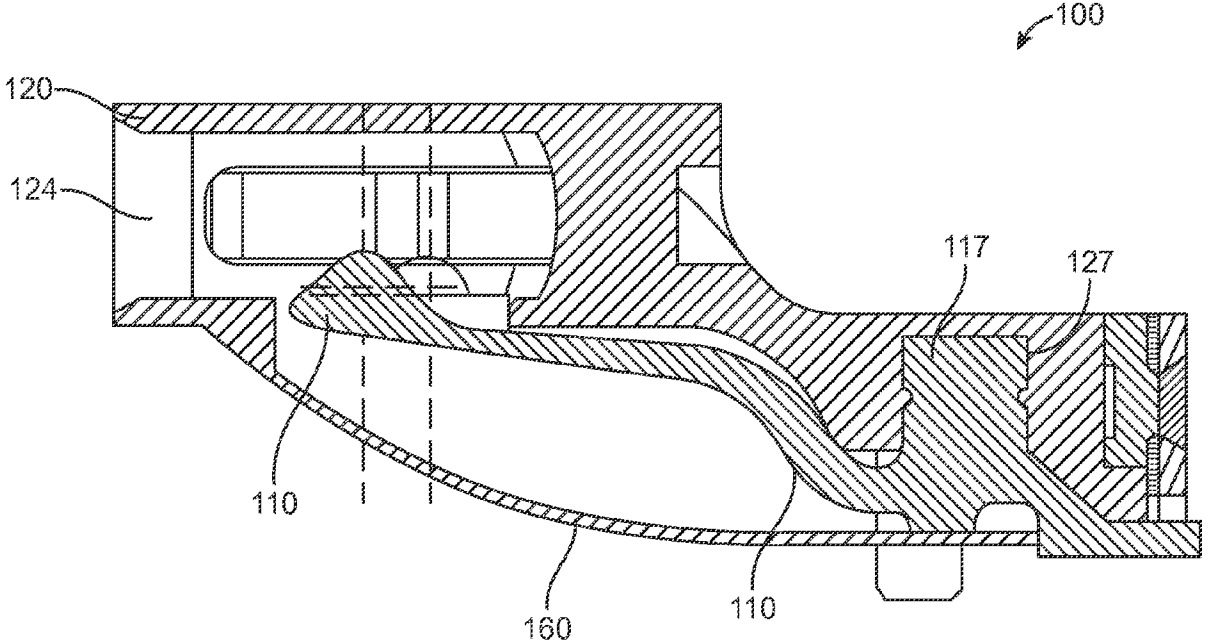
FIG. 7 illustrates a cutaway side view of a connector receptacle according to embodiment of the present invention.

FIG. 7 illustrates a cutaway side view of a connector receptacle according to embodiment of the present invention. As can be seen, housing 120 may have an opening in its bottom. Cover or tape piece 160 may be used to cover this opening after contacts 110 have been inserted into housing 120. This cover may be used to protect contacts 110.

During assembly, contacts 110 may be inserted into housing 120 via this opening. Specifically, mechanical stabilization portion 117 may fit into slots 127 in housing 120. Once the contacts are in place, tape or cover 160 may be attached. Connector 100 may include front opening 124 for accepting a connector insert.

Figure 8:
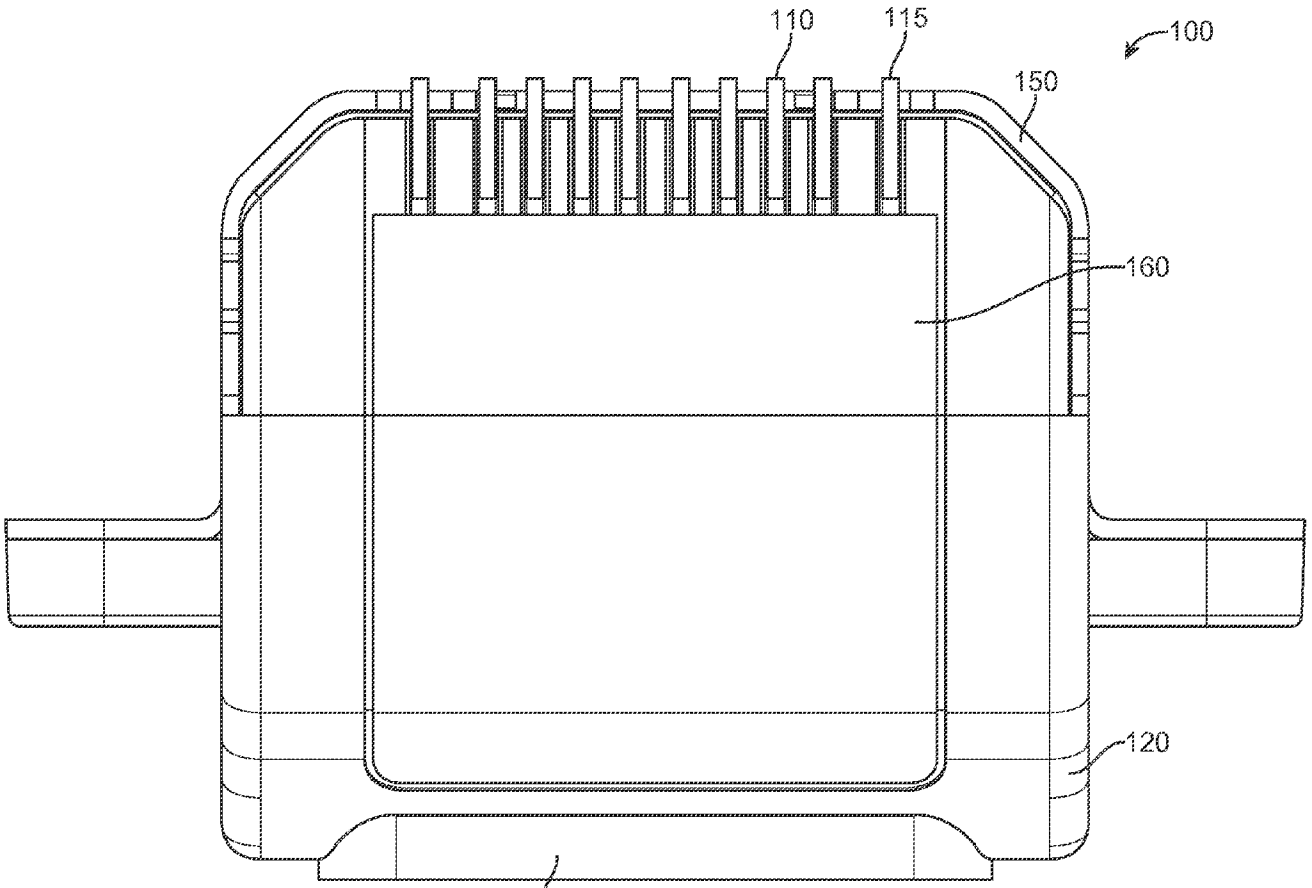
FIG. 8 illustrates a bottom view of a connector receptacle according to an embodiment of the present invention.

FIG. 8 illustrates a bottom view of a connector receptacle according to an embodiment of the present invention. Connector receptacle 100 may include housing 120 having a front side opening 124 to accept a connector insert. Connector receptacle 100 may include contacts 110 and 115. As before, tape or cover 160 may cover a bottom opening in housing 120. Bracket 150 may fit over a back of connector receptacle 100.

In this specific embodiment of the present invention, curved surfaces 127 and 129 are contoured to fit in device enclosure and avoid internal circuitry. Other embodiments of the present invention may provide connector receptacles having other contours. An example is shown in the following figure.

Figure 9:
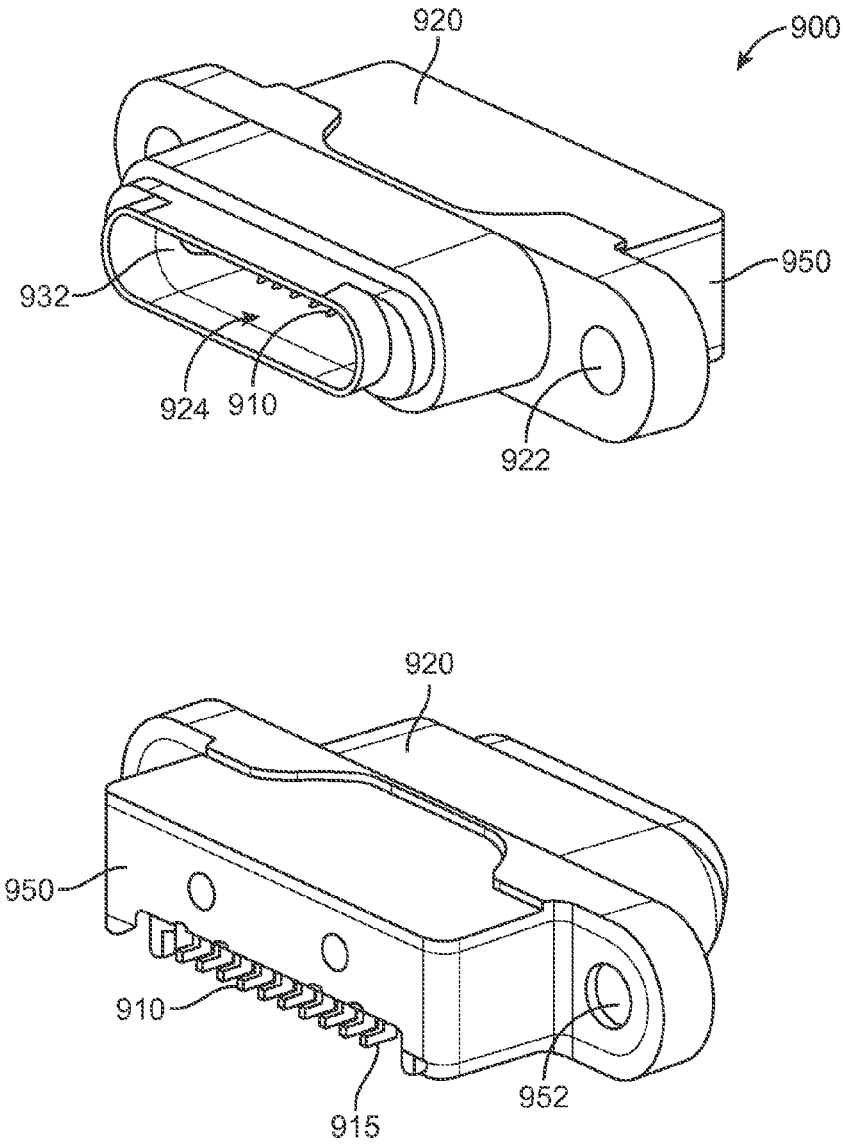
FIG. 9 illustrates front and back oblique views of another connector receptacle according to an embodiment of the present invention.

FIG. 9 illustrates front and back oblique views of another connector receptacle according to an embodiment of the present invention. Connector receptacle 900 may include housing 920 having fastener openings 922 and a front side opening 924 for accepting a connector insert. Connector receptacle 900 may include side ground contacts 932 and bottom or signal contacts 910 and 915. Connector receptacle 900 may further include bracket 950, which may have fastener openings 952.

Figure 10:
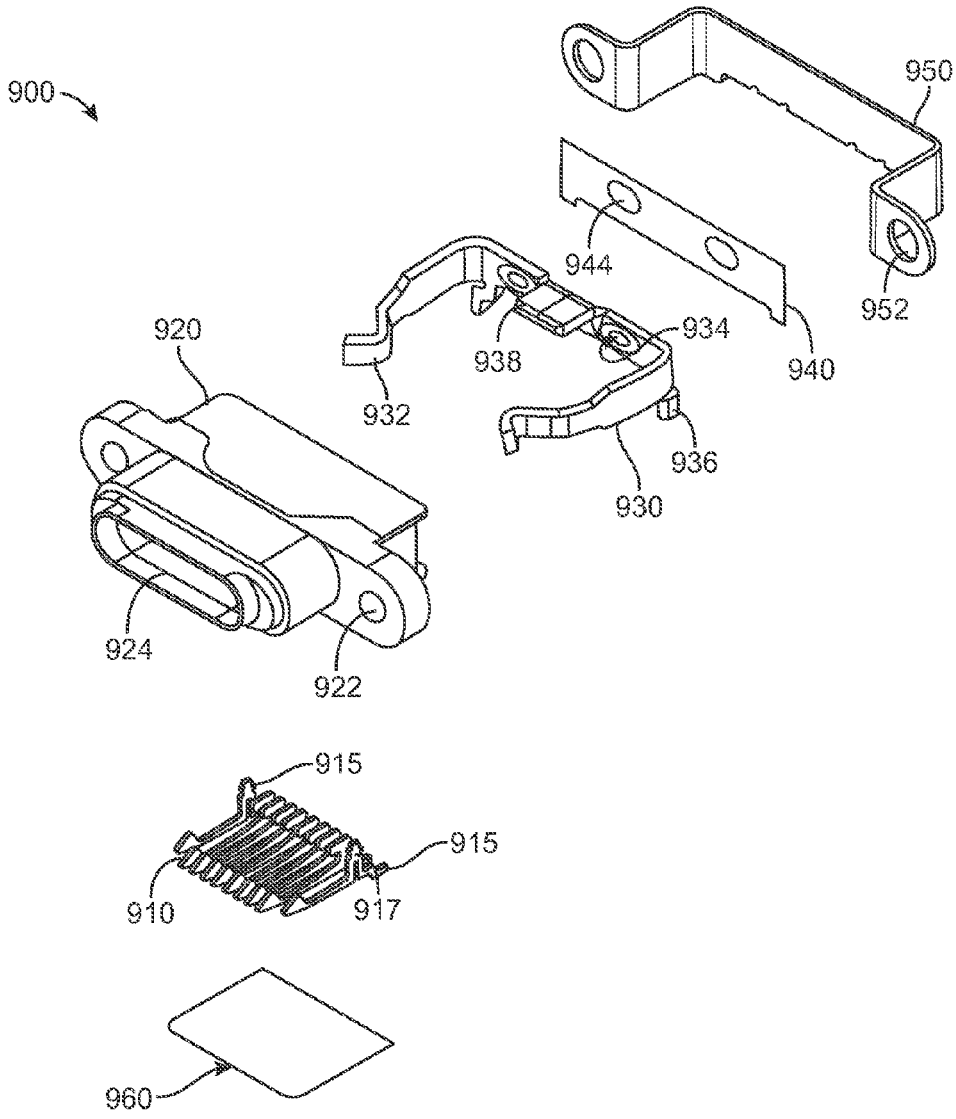
FIG. 10 illustrates an exploded view of another connector receptacle according to an embodiment of the present invention.

FIG. 10 illustrates an exploded view of another connector receptacle according to an embodiment of the present invention. Connector receptacle 900 may include housing 920 having fastener openings 922 and a front side opening 924 to accept a connector insert. Latch or ground piece 930 may be least partially inserted in a back opening of housing 920. Side ground contacts 932 may be placed inside housing 920. Tape portion 940 may fit over a back of latch or ground piece 930. Specifically, openings 944 may align with protrusions 934. Bracket 950 may be placed over a rear portion of ground piece 930 and housing 920. Protrusions 934 may be laser or spot-welded to bracket 950 to secure bracket 950 in place.

The contacts, ground pieces, ground contacts, brackets, and other components in this and the other included examples, and in other embodiments of the present invention, may be formed of plastic, metal, ceramic, or other materials. For example, they may be formed of stainless steel, such as stainless steel (304), stainless steel (301), or low carbon steel (1010), titanium, brass, gold-plated brass, or other appropriate material.

As before, contacts 910 and 915 may be inserted into housing 920 through an opening in bottom of housing 920. Specifically, mechanical stabilization portions 917 may be inserted into slots in housing 920. Once these contacts are in place, tape or cover 960 may be used to cover this opening and protect contacts 910 and 915.

Again, latch or ground piece 930 (or 130 or the other ground pieces included below) may have contacts 932 spread apart during assembly, and again during insertion of connector inserts. This may permanently work the ground contacts 932 apart, reducing ground contact reliability and reducing retention force. The latch or ground piece 930 is shown in more detail in the following figure.

Figure 11:
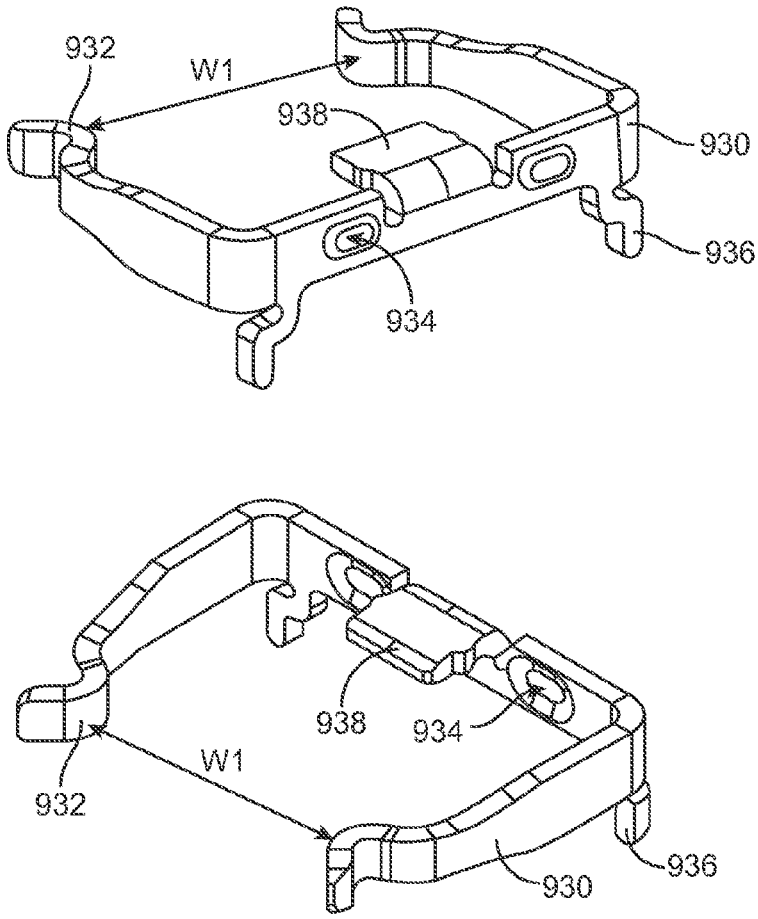
FIG. 11 illustrates front and rear oblique views of a ground piece according to an embodiment of the present invention.

FIG. 11 illustrates front and rear oblique views of latch or ground piece 930 according to an embodiment of the present invention. Again, the distance W1 between contacts 932 of latch or ground piece 930 may increase due to stresses from assembly and insertion of connector inserts. This increase in W1 may lead to reduced retention force and reduced ground contact reliability.

To mitigate, reduce, or eliminate this increase, latch or ground piece 930 (and 130) may undergo various processing steps. For example, latch or ground piece 930 may be annealed. After annealing, latch or ground piece 930 may further be hardened. In other embodiments of the present invention, the annealing step may be omitted, while in other embodiments of the present invention, one or more annealing, hardening, and other processing steps may be used. Latch or ground piece 930 (or 130 or the other ground pieces included below) may be formed of stainless steel, such as stainless steel (304), stainless steel (301), or low carbon steel (1010), titanium, brass, gold-plated brass, or other appropriate material.

Other embodiments of the present invention may employ different connector receptacles. Some examples are shown in the following figures.

Figure 12:
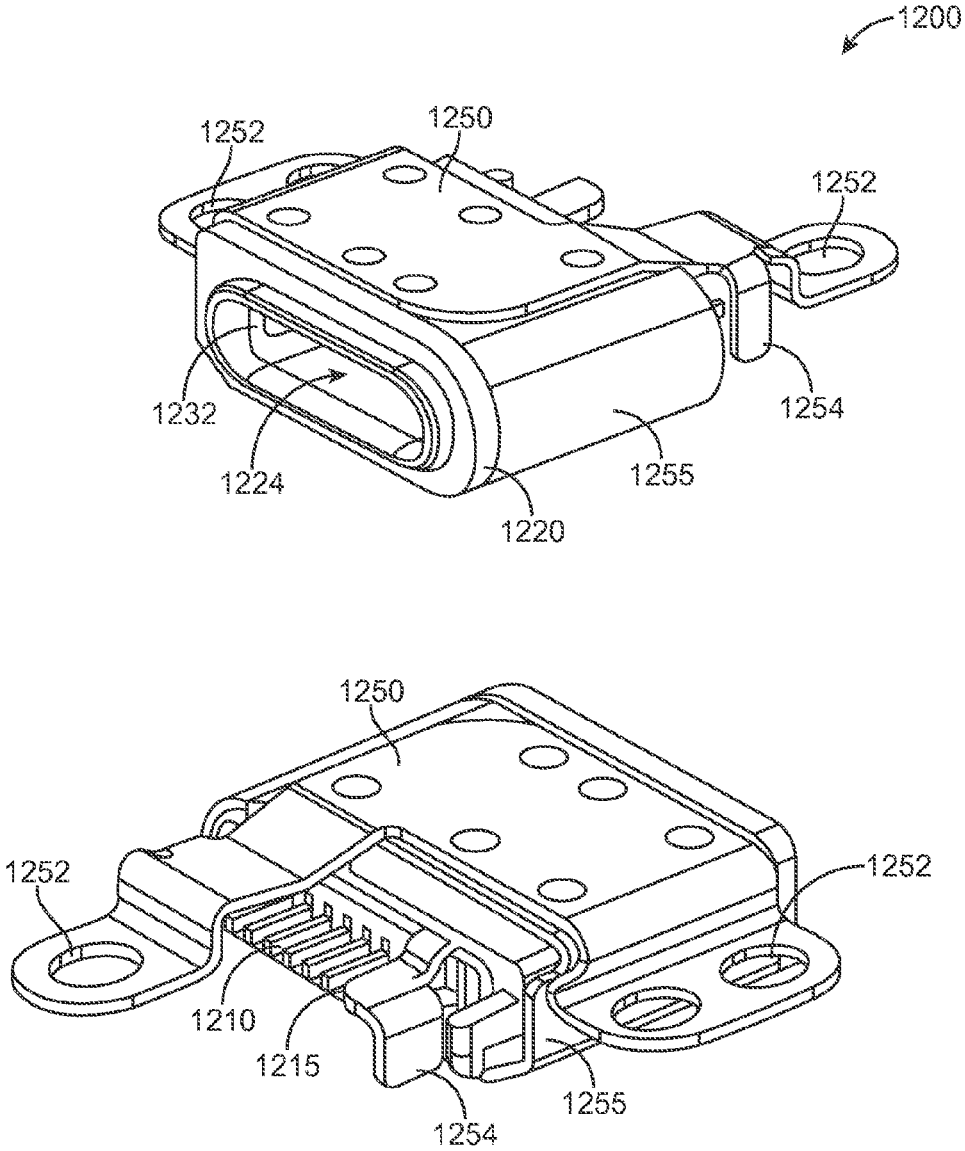
FIG. 12 illustrates front and back oblique views of another connector receptacle according to an embodiment of the present invention.

FIG. 12 illustrates front and back oblique views of another connector receptacle according to an embodiment of the present invention. Connector receptacle 1200 may include housing 1220 having an opening 1224 for accepting a connector insert. Connector receptacle 1200 may include side ground contacts 1232 and signal or bottom contacts 1210 and 1215. Connector receptacle 1200 may further include shield 1255. Bracket 1250 may be laser or spot-welded to shield 1255. Bracket 1250 may include openings 1252. Openings 1252 may accept fasteners which may attach connector receptacle 1200 to a device enclosure or other structure. Tabs 1254 may be used to fix connector receptacle 1200 to a main logic board, device enclosure, or other structure.

Figure 13:
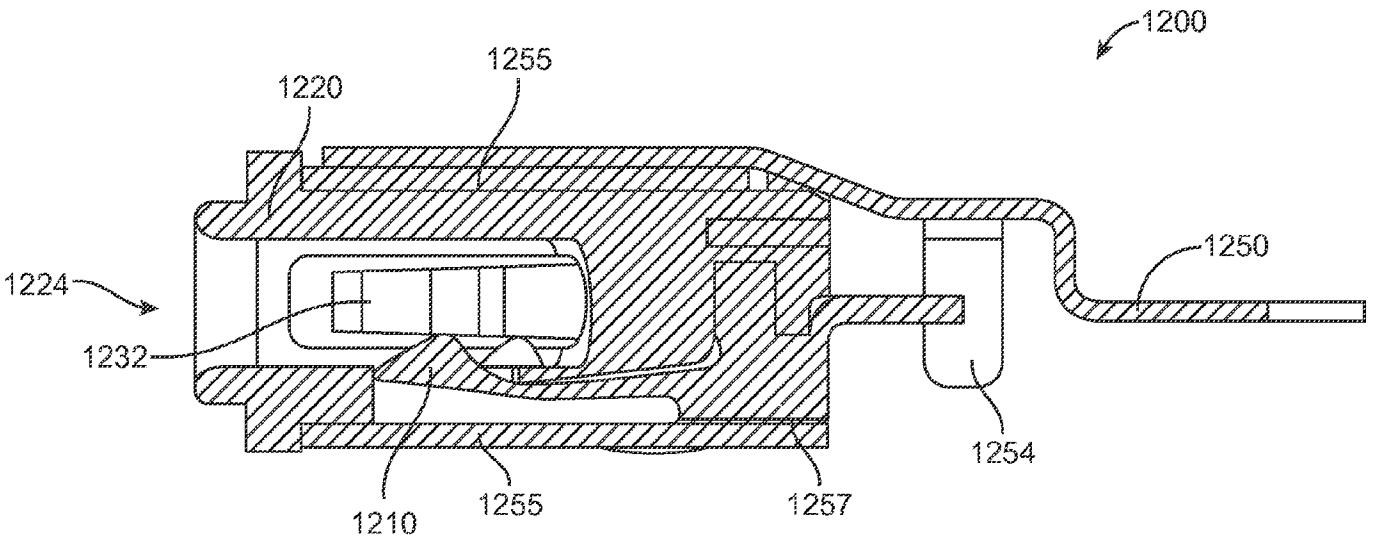
FIG. 13 illustrates a side view of a connector receptacle according to an embodiment of the present invention.

FIG. 13 illustrates a side view of a connector receptacle according to an embodiment of the present invention. Again, connector receptacle 1200 may include housing 1220 around contacts 1210 and 1232. Shield 1255 may be placed at least partially around housing 1220. Shield 1255 may cover the bottom side opening to protect contacts 1210. Shield 1255 may be insulated from contacts 1210 by insulative layer 1257. Bracket 1250 may be attached to shield 1255. Tabs 1254 may extend from shield 1250.

Figure 14:
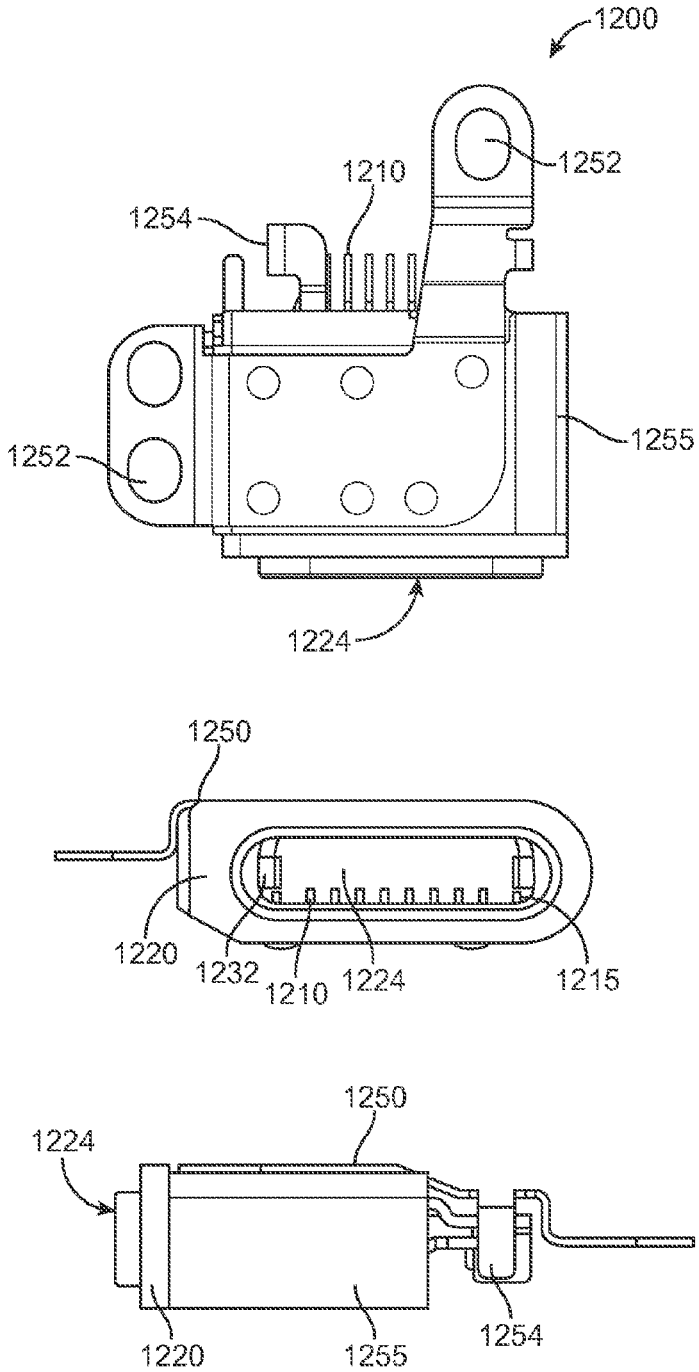
FIG. 14 illustrates top, front, and side views of a connector receptacle according to an embodiment of the present invention.

FIG. 14 illustrates top, front, and side views of a connector receptacle according to an embodiment of the present invention. Again, connector receptacle 1200 may include a front side opening 1224 and housing 1220 which may provide access to side ground contacts 1232 and bottom contacts 1210 and 1215. Housing 1220 may be at least partially encased by shield 1255. Bracket 1250 may attach to shield 1255. Tab 1254 may extend from shield 1250. Bracket 1250 may include openings 1252, which may accept fasteners to secure connector receptacle 1200 to a device enclosure or other structure.

In this example, contacts 1210 and 1215 may be inserted through a bottom opening in housing 1220. A latch including side ground contacts 1232 may be inserted into housing 1220. Tape or insulation 1257 may be applied. Shield 1255 may be fixed around housing 1220. Bracket 1250 may be soldered or spot-welded to shield 1255.

Figure 15:
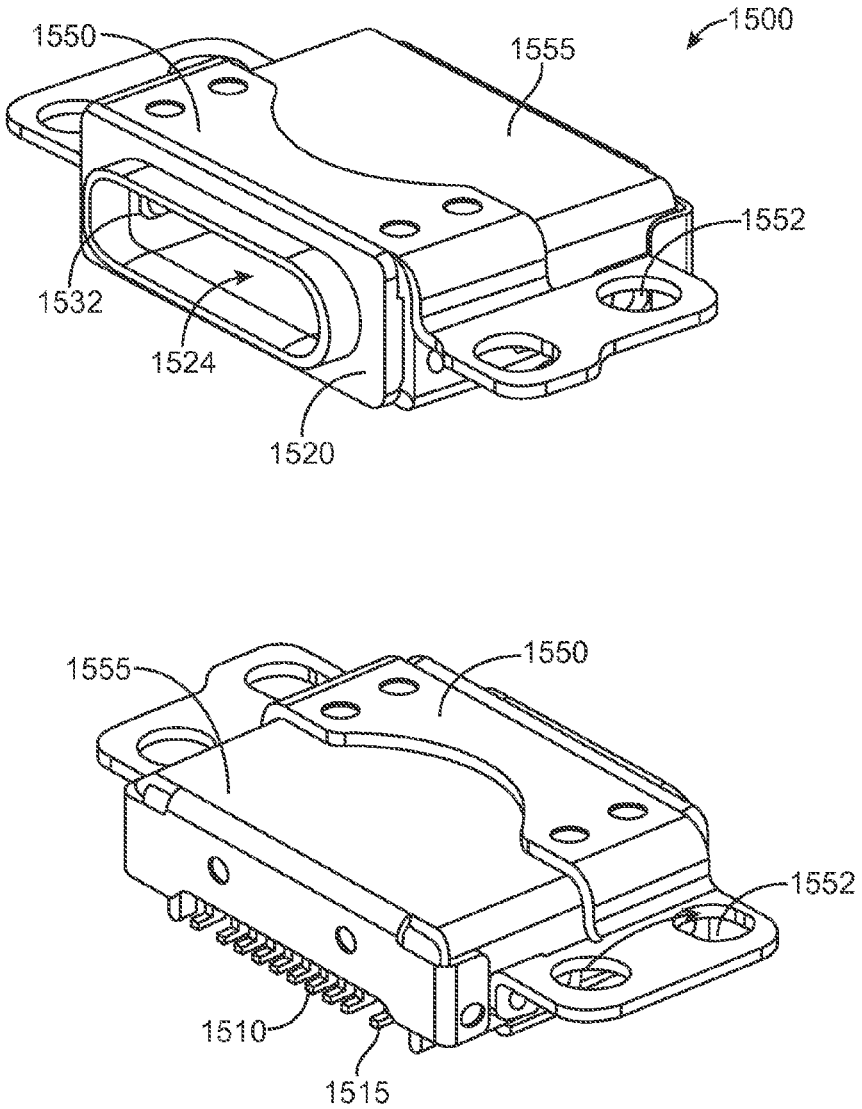
FIG. 15 illustrates front and back oblique views of another connector receptacle according to an embodiment of the present invention.

FIG. 15 illustrates front and back oblique views of another connector receptacle according to an embodiment of the present invention. Connector receptacle 1500 may include housing 1520 having an opening 1524 for accepting a connector insert. Connector receptacle 1500 may include side ground contacts 1532 and signal or bottom contacts 1510 and 1515. Connector receptacle 1500 may further include shield 1555. Bracket 1550 may be laser or spot-welded to shield 1555. Bracket 1550 may include openings 1552. Openings 1552 may accept fasteners which may attach connector receptacle 1500 to a device enclosure or other structure.

Figure 16:
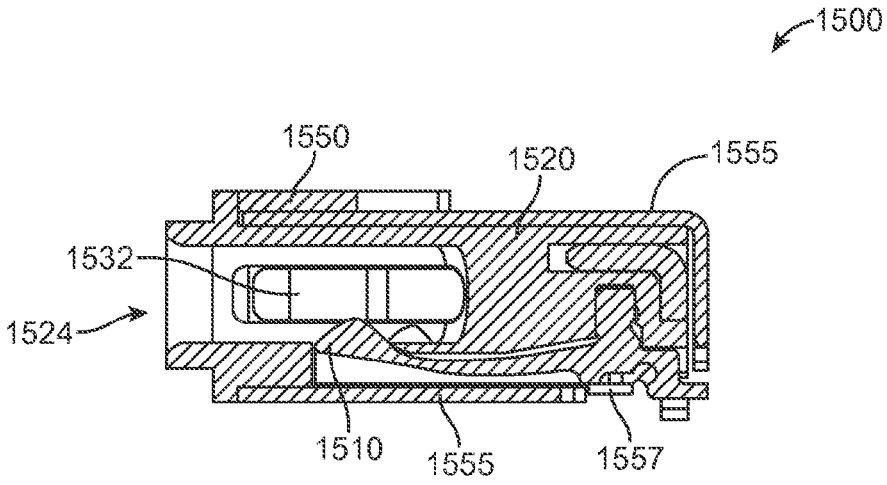
FIG. 16 illustrates a side view of a connector receptacle according to an embodiment of the present invention.

FIG. 16 illustrates a side view of a connector receptacle according to an embodiment of the present invention. Again, connector receptacle 1500 may include housing 1520 around contacts 1510 and 1532. Shield 1555 may be placed at least partially around housing 1520. Shield 1555 may cover the bottom side opening to protect contacts 1510 (and 1515). Shield 1555 may be insulated from contacts 1510 by insulative layer 1557. Bracket 1550 may be attached to shield 1555.

Figure 17:
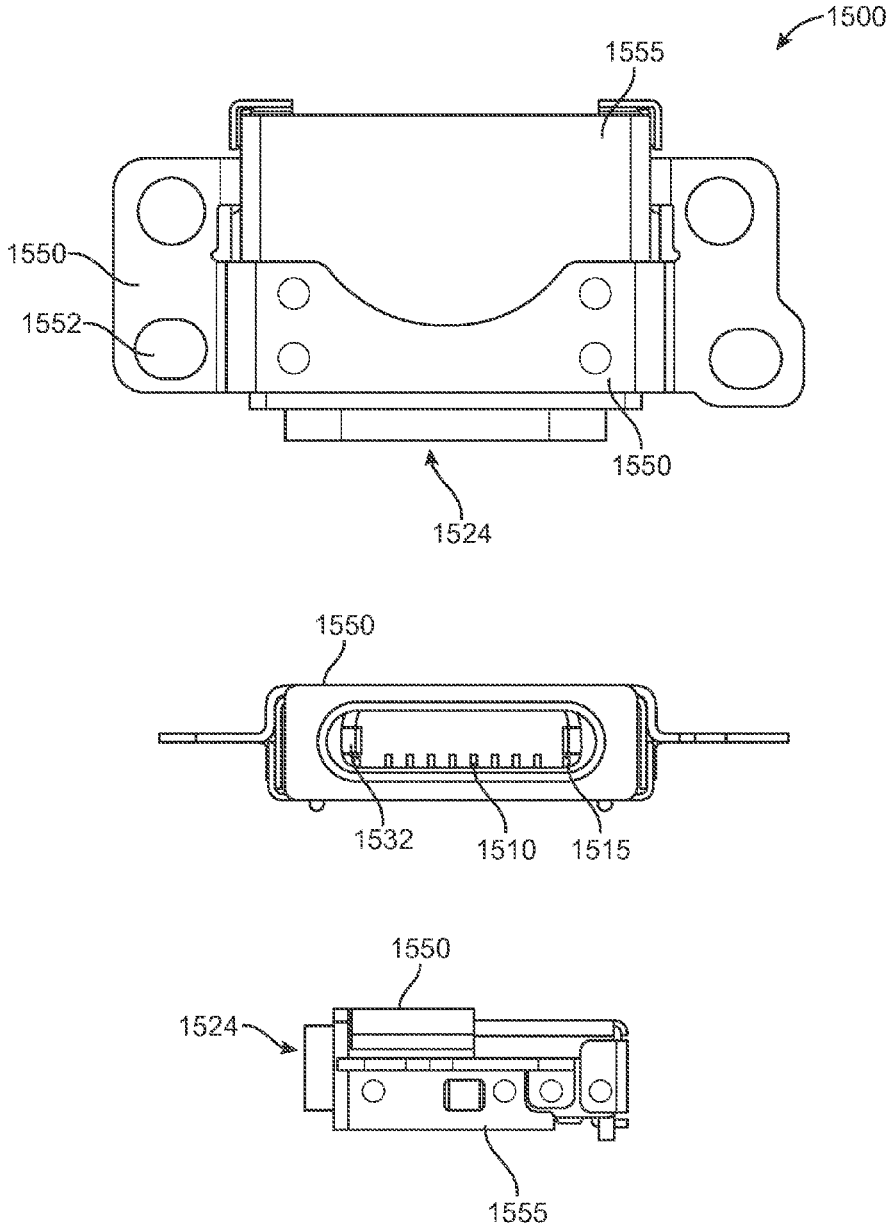
FIG. 17 illustrates top, front, and side views of a connector receptacle according to an embodiment of the present invention.

FIG. 17 illustrates top, front, and side views of a connector receptacle according to an embodiment of the present invention. Again, connector receptacle 1500 may include a front side opening 1524 and housing 1520 which may provide access to side ground contacts 1532 and bottom contacts 1510 and 1515. Housing 1520 may be at least partially encased by shield 1555. Bracket 1550 may attach to shield 1555. Bracket 1550 may include openings 1552, which may accept fasteners to secure connector receptacle 1500 to a device enclosure or other structure.

In this example, contacts 1510 and 1515 may be inserted through a bottom opening in housing 1520. A latch including side ground contacts 1532 may be inserted into housing 1520. Tape or insulation 1557 may be applied. Shield 1555 may be fixed around housing 1520. Bracket 1550 may be soldered or spot-welded to shield 1555.

Figure 18:
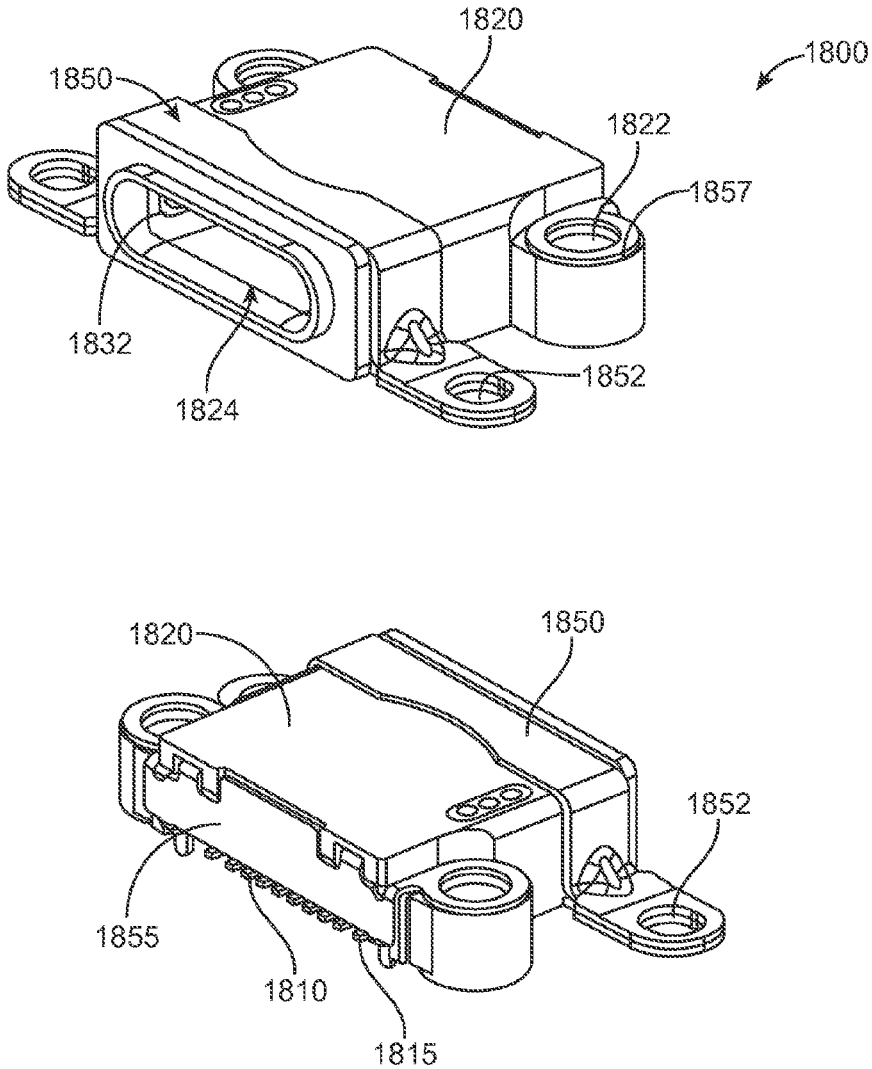
FIG. 18 illustrates front and back oblique views of another connector receptacle according to an embodiment of the present invention.

FIG. 18 illustrates front and back oblique views of another connector receptacle according to an embodiment of the present invention. Connector receptacle 1800 may include housing 1820 having an opening 1824 for accepting a connector insert. Connector receptacle 1800 may include side ground contacts 1832 and signal or bottom contacts 1810 and 1815. Connector receptacle 1800 may further include shield 1855. Bracket 1850 may include openings 1852. Housing 1820 may include openings 1822 and shield 1855 may include openings 1857. Openings 1852, 1822, and 1857 may accept fasteners which may attach connector receptacle 1800 to a device enclosure or other structure.

Figure 19:
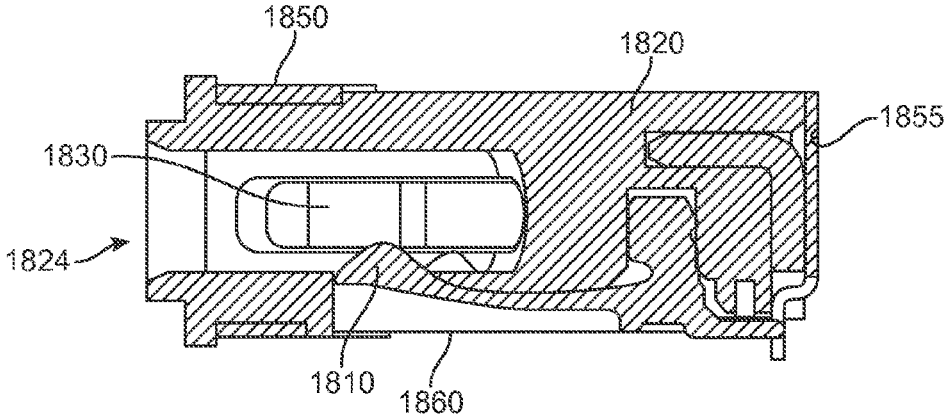
FIG. 19 illustrates a side view of a connector receptacle according to an embodiment of the present invention.

FIG. 19 illustrates a side view of a connector receptacle according to an embodiment of the present invention. Again, connector receptacle 1800 may include housing 1820 around contacts 1810 (and 1815) and 1832. Shield 1855 may be placed along a rear of housing 1820. Tape portion 1860 may cover the bottom side opening to protect contacts 1810 (and 1815).

Figure 20:
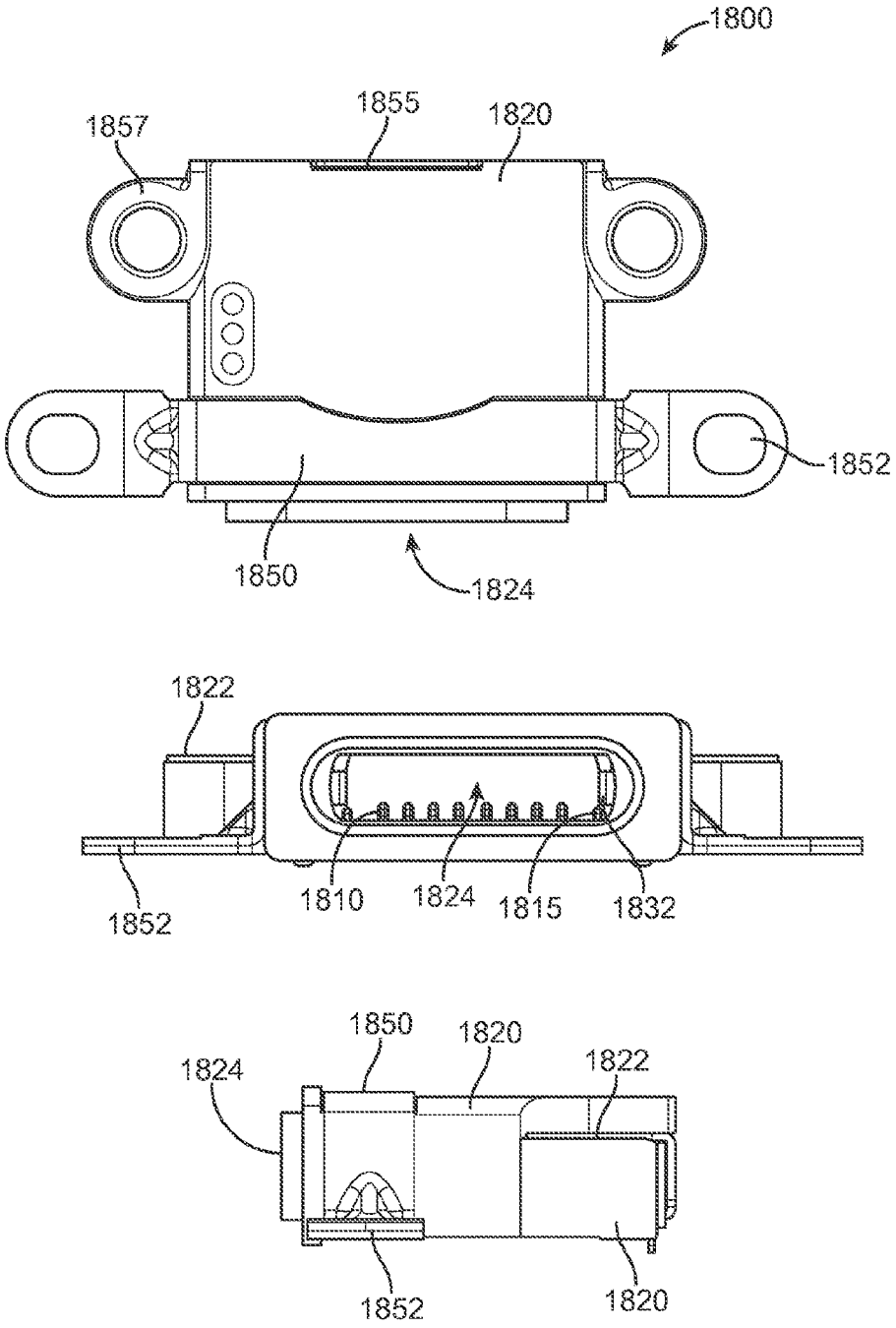
FIG. 20 illustrates top, front, and side views of a connector receptacle according to an embodiment of the present invention.

FIG. 20 illustrates top, front, and side views of a connector receptacle according to an embodiment of the present invention. Again, connector receptacle 1800 may include a front side opening 1824 and housing 1820 which may provide access to side ground contacts 1832 and bottom contacts 1810 and 1815. A rear portion of housing 1820 may be at least partially covered by shield 1855. Bracket 1850 may include openings 1852, housing 1820 may include openings 1822, and shield 1855 may include openings 1857, which may accept fasteners to secure connector receptacle 1800 to a device enclosure or other structure.

In this example, contacts 1810 and 1815 may be inserted through a bottom opening in housing 1820. A latch including side ground contacts 1832 may be inserted into housing 1820. Tape or insulation 1860 may be applied to protect contacts 1810 and 1815. Shield 1855 may be fixed around a rear portion of housing 1820. Bracket 1850 may be attached to housing 1820.

Again, embodiments of the present invention may provide connector receptacles that are readily assembled. A connector receptacle according to an embodiment of the present invention that may minimize assembly processes is shown in the following figure.

Figure 21:
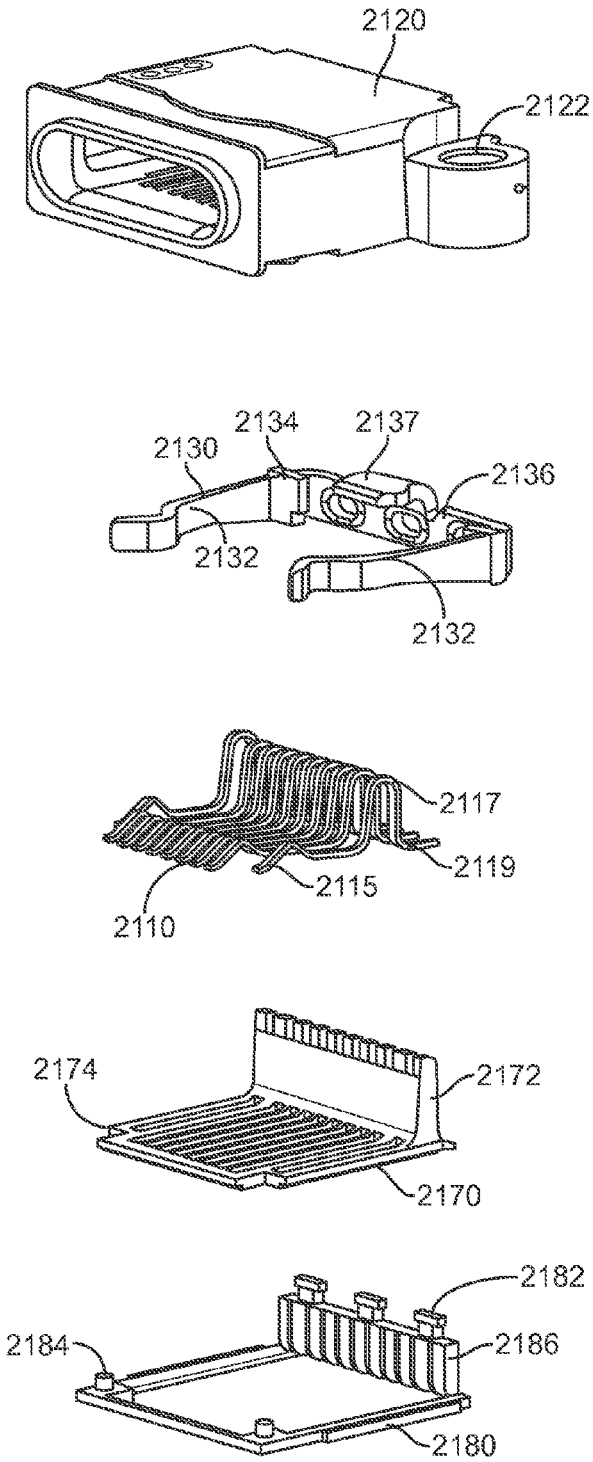
FIG. 21 illustrates various components of a connector receptacle according to another embodiment of the present invention.

FIG. 21 illustrates various components of a connector receptacle according to another embodiment of the present invention. Housing 2120 may have opening 2122. Housing 2120 may be injection molded or formed in another appropriate manner. Housing 2120 may be formed of plastic, nylon, or other nonconductive material. Opening 2122 may accept a fastener to mount housing 2122 a printed circuit board, flexible circuit board, device enclosure, or other appropriate substrate.

Latch or ground piece 2130 may include arms 2132 joined by back piece 2136. Latch or ground piece 2130 may include plugs 2134. Plugs 2134 may be formed of plastic or other material and insert molded onto latch 2130 arms 2132. Arms 2132 may form side ground contacts, as above. Latch or ground piece 2130 may be formed as the latch ground pieces above, such as latch or ground piece 930 in FIG. 11.

Contacts 2110 and 2115 may include raised portions 2117 and surface mount portions 2119. Contacts 2110 and 2115 may be formed of stainless steel, such as stainless steel (304), stainless steel (301), or low carbon steel (1010), titanium, brass, gold-plated brass, or other appropriate material.

Contact tray 2170 may include raised portion 2172 and notches 2174. Contact tray 2170 may be injection molded or formed using another appropriate method. Contact tray 2170 may be formed of plastic, nylon, or other nonconductive material.

Frame 2180 may include interlocking portions 2182 and tabs 2184. Frame 2180 may be insert molded, or formed in another appropriate manner. For example, frame 2180 may be insert molded in place between contact tray 2170 and housing 2180, as shown below. Frame 2180 may be formed of plastic, nylon, or other material.

During assembly, latch 2130 may be inserted into housing 2120 through opening (not shown) in a back of housing 2120. Tab 2137 may be fit into a corresponding notch or cutout (not shown) in housing 2120. In other embodiments of the present invention, latch 2130 may be inserted through other openings, such as an opening in a bottom of housing 2120, or through an opening in a bottom-rear portion of housing 2120.

Contacts 2110 and 2115 may be placed in contact tray 2170. Using contact tray 2170 may provide a support mechanism for contacts 2110 and 2115 that may improve the contact's co-planarity, that is, it may improve the alignment of contacts 2110 and 2115 to each other. Contact tray 2170 may be inserted or fit into a bottom opening in housing 2120.

Various embodiments of the present invention may provide connector receptacles having a robust water seal. In a specific embodiment of the present invention, this may be accomplished by insert molding a frame between contact tray 2170 and housing 2120 to secure contact tray 2170 in place. The resulting frame 2180 may seal ingress paths between housing 2120 and contact tray 2170. Frame 2180 may also be used to close openings in a backside or elsewhere on housing 2120. For example, an opening used to allow the insertion of latch or ground piece 2130 may be closed or sealed by frame 2180. This seal may also be more secure than adhesives. Frame 2180 may also secure contacts 2110 and 2115 to housing 2120 by being formed around, or at least partially around, at least a portion of contacts 2110 and 2115. In one embodiment of the present invention, a raised portion 2186 of frame 2180 may be at least partially formed around raised portions 2117 of contacts 2110 and 2115.

In other embodiments of the present invention, frame 2180 may be placed between contact tray 2170 and housing 2120 to secure contact tray 2170 in place. This may be done by placing interlocking portions 2182 into corresponding interlocking portions in a back of housing 2120, and replacing tabs 2184 in notches 2174 in contact tray 2170. Additionally, other interlocking features, adhesives, or other methods may be used to secure Frame 2180 in place. A shield, such as shield 1855 in FIG. 18, may be placed around a portion of housing 2120.

Figure 22:
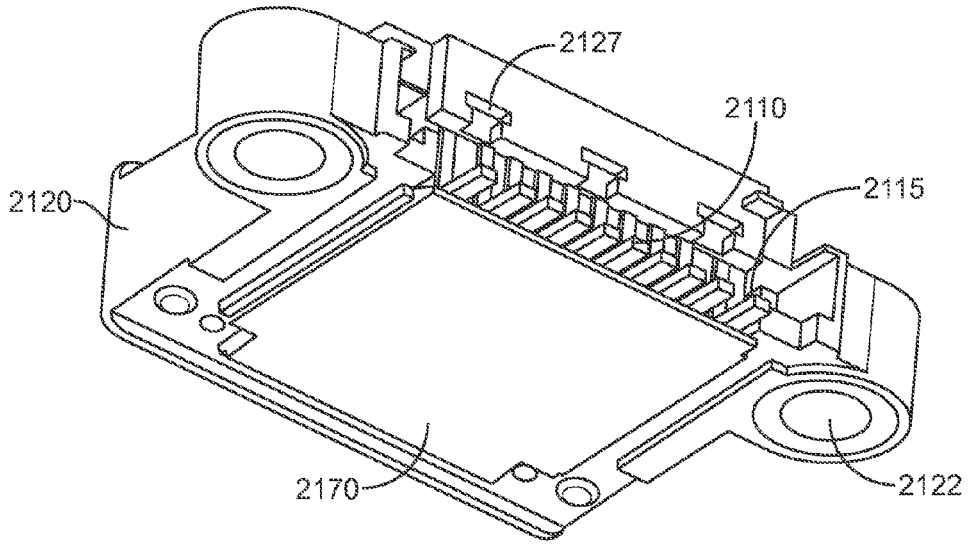
FIG. 22 illustrates an underside oblique view of a connector receptacle according to embodiment of the present invention.

FIG. 22 illustrates an underside oblique view of a connector receptacle according to embodiment of the present invention. This view illustrates interlocking features 2127 on a back of housing 2120. Surface mount portions of contacts 2110 and 2115 are exposed. These surface mount portions may be soldered or otherwise joined to traces on a printed circuit board, flexible circuit board, or other appropriate substrate. In this figure, contact tray 2170 may be fit into an opening in a bottom of housing 2120. Again, housing 2120 may include openings 2122 to accept fasteners.

Figure 23:
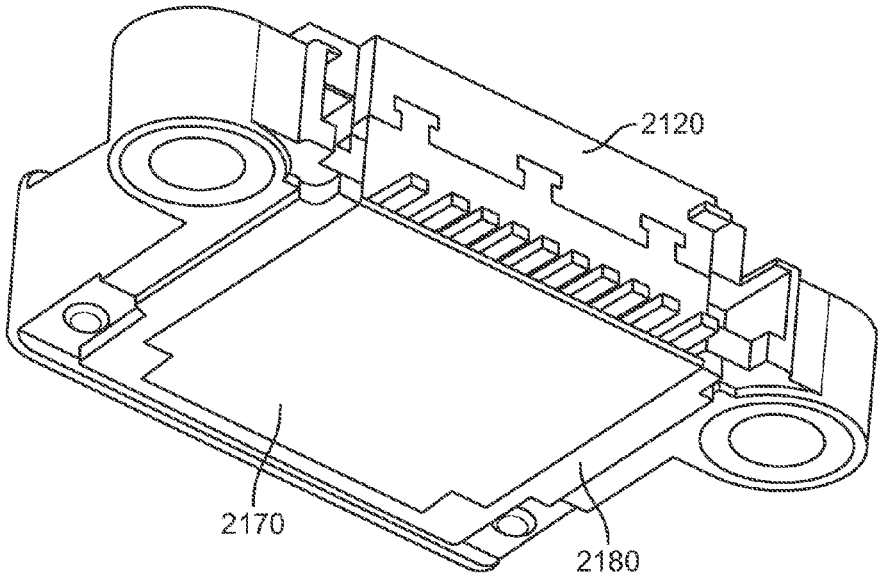
FIG. 23 illustrates another underside oblique view of a connector receptacle according to an embodiment of the present invention.

FIG. 23 illustrates another underside oblique view of a connector receptacle according to an embodiment of the present invention. In this figure, frame 2180 has been insert molded or otherwise fit between contact tray 2170 and housing 2120 to secure contact tray 2170 in place. Again, in embodiments of the present invention, frame 2180 may be molded in place between contact tray 2170 and housing 2120. For example, frame 2180 may be insert molded between contact tray 2170 and housing 2120. Frame 2180 may also be insert molded to cover a back opening of the receptacle, and to hold contacts 2110 and 2115 in place. This, in turn, may form a highly water resistant connector receptacle. This may help prevent water present at an outside of a device from entering the device through the connector receptacle.

Figure 24:
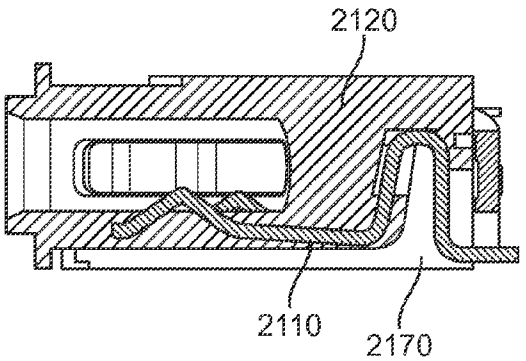
FIG. 24 illustrates cutaway side views of a connector receptacle according to an embodiment of the present invention.
Figure 24:
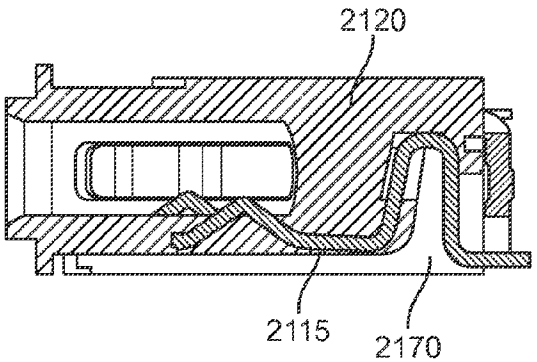

FIG. 24 illustrates cutaway side views of a connector receptacle according to an embodiment of the present invention. In this example, contacts 2110 and 2115 may reside on contact tray 2170 inside housing 2120. Contacts 2110 and 2115 may include pre-biased cantilevered beams to form electrical connections with contacts on a connector insert.

Figure 25:
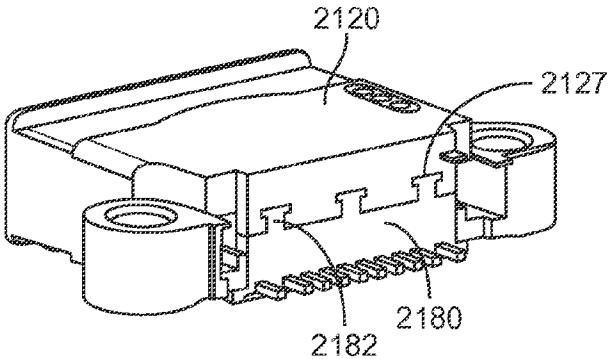
FIG. 25 illustrates a back side of a connector receptacle according to embodiments of the present invention.
Figure 25:
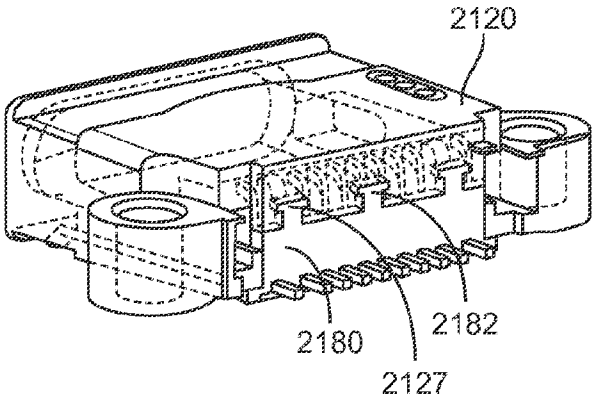

FIG. 25 illustrates a back side of a connector receptacle according to embodiments of the present invention. This view illustrates interlocking portions 2182 on frame 2180 fitting into corresponding interlocking cutouts 2127 on housing

2120. Again, an opening used to insert latch or ground piece 2130 in housing 2120 may be sealed or covered by frame 2180.

Embodiments of the present invention may provide connector receptacles that are configured to accept various connector inserts. Some embodiments of the present invention may provide a connector receptacle that is configured to accept connector inserts in at least two orientations. That is, they may accept connector inserts having a first or right-side-up orientation and a second or up-side-down orientation. Examples of these connector inserts, and their pinouts, can be found in U.S. provisional application Nos. 61/565,372, filed Nov. 30, 2011, titled Dual Orientation Electronic Connector with External Contacts, and 61/694,423; filed Aug. 29, 2012, titled Dual Orientation Electronic Connector, which are incorporated by reference. With these embodiments of the present invention, circuitry may be included in the device and associated with the connector receptacle to adjust for the orientation of a connector insert. This circuitry is described further in U.S. provisional application No. 61/565,463, filed Nov. 30, 2011, titled Techniques for Configuring Contacts of a Connector, which is incorporated by reference.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:
- a housing having a front opening and a bottom opening;
- a plurality of contacts, each contact including:
  - a beam portion arranged to form an electrical connection with a corresponding contact on a connector insert when the connector insert is inserted into the connector receptacle; and
  - a surface mount contact portion substantially in line with the beam portion;
- a contact tray supporting the plurality of contacts;
- a latch including two arms, the arms joined by a back piece, the latch arms forming side contacts on sides of the front opening of the housing; and
- a frame positioned in the bottom opening of the housing to secure the contact tray in place, wherein the frame fits around the contact tray between the contact tray and the opening in the bottom of the housing and wherein tabs on the frame fit in notches on the contact tray.

2. The connector receptacle of claim 1 wherein each contact further includes a mechanical stabilizing portion substantially orthogonal to the beam portion.

3. The connector receptacle of claim 2 wherein the mechanical stabilizing portion includes a raised portion formed by at least two bends in the contact.

4. The connector receptacle of claim 3 wherein the raised portion of each contact fits over a raised portion of the contact tray.

5. The connector receptacle of claim 4 wherein the raised portion of the contact tray fits between plugs on the latch arms and the back piece of the latch.

6. The connector receptacle of claim 1 wherein interlocking features on the frame fit into interlocking features on the housing.

7. The connector receptacle of claim 1 wherein interlocking features on a back of the frame fit into interlocking features on the back of the housing.

8. The connector receptacle of claim 1 wherein the beam portions of the contacts are pre-biased in a direction away from the bottom of the housing.

9. The connector receptacle of claim 1 wherein the contact tray aligns the plurality of contacts to each other.

10. The connector receptacle of claim 1 wherein the contact tray improves the co-planarity of the plurality of contacts.

11. The connector receptacle of claim 1 wherein the frame fits around the contact tray between the contact tray and the opening in the bottom of the housing to form a water seal.

12. A connector receptacle comprising:
- a housing having a front opening and a bottom opening;
- a plurality of contacts, each contact including:
  - a beam portion; and
  - a surface mount contact portion substantially in line with the beam portion;
- a contact tray to support and align the plurality of contacts to each other, wherein the contact tray is inserted into the bottom opening of the housing;
- a latch including two arms, the arms joined by a back piece, the latch arms forming side contacts in the front opening of the housing; and
- an insert molded frame positioned in the bottom opening of the housing to form a seal between the contact tray and the bottom opening in the housing, wherein the frame fits around the contact tray between the contact tray and the bottom opening of the housing and wherein interlocking features on a back of the frame fit into interlocking features on the back of the housing.

13. The connector receptacle of claim 12 wherein each contact further includes a mechanical stabilizing portion substantially orthogonal to the beam portion, and wherein the mechanical stabilizing portion includes a raised portion formed by at least two bends in the contact, wherein the raised portion of each contact fits over a raised portion of the contact tray.

14. The connector receptacle of claim 13 wherein the latch includes a plug on each of the two arms and the raised portion of the contact tray fits between the plugs on the latch arms and the back piece of the latch.

15. The connector receptacle of claim 12 wherein the frame fits around the contact tray to form a water seal.

16. A connector receptacle comprising:
- a housing having a front opening and a bottom opening;
- a plurality of contacts, each contact including:
  - a beam portion;
  - a surface mount contact portion substantially in line with the beam portion; and
  - a raised portion;
- a contact tray supporting the plurality of contacts, wherein the raised portion of each contact fits over a raised portion of the contact tray;
- a latch including a plug on each of two arms, the arms joined by a back piece, the latch arms forming side contacts on sides of the front opening of the housing, wherein the raised portion of the contact tray fits between the plugs on the latch arms and the back piece of the latch; and
- a frame positioned in the bottom opening of the housing to secure the contact tray in place, wherein the frame fits around the contact tray between the contact tray and the bottom opening of the housing.

17. The connector receptacle of claim 16 wherein the frame fits around the contact tray to form a water seal.

* * * * *